US007615938B2

(12) United States Patent
Prouse

(10) Patent No.: US 7,615,938 B2
(45) Date of Patent: Nov. 10, 2009

(54) METHOD AND SYSTEM FOR VARIABLE LED OUTPUT IN AN ELECTRONIC DEVICE

(75) Inventor: Craig Prouse, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 780 days.

(21) Appl. No.: 11/101,025

(22) Filed: Apr. 6, 2005

(65) Prior Publication Data

US 2006/0226790 A1 Oct. 12, 2006

(51) Int. Cl.
*H05B 37/02* (2006.01)
*G09G 3/14* (2006.01)

(52) U.S. Cl. ..... 315/291; 345/46

(58) Field of Classification Search ..... 315/246, 315/291; 250/458.01; 345/45, 102; 257/88
See application file for complete search history.

(56) References Cited

U.S. PATENT DOCUMENTS

| | | | | |
|---|---|---|---|---|
| 5,634,711 | A * | 6/1997 | Kennedy et al. | 362/119 |
| 5,805,793 | A * | 9/1998 | Green | 714/32 |
| 6,157,037 | A * | 12/2000 | Danielson | 250/458.1 |
| 6,515,740 | B2 * | 2/2003 | Bamji et al. | 356/141.1 |
| 6,888,633 | B2 * | 5/2005 | Vander Jagt et al. | 356/407 |
| 2004/0116788 | A1 * | 6/2004 | Chernoguz et al. | 600/322 |
| 2006/0010182 | A1 * | 1/2006 | Altepeter et al. | 708/250 |
| 2006/0164645 | A1 * | 7/2006 | Hietanen et al. | 356/430 |

* cited by examiner

*Primary Examiner*—Hung T Vy
(74) *Attorney, Agent, or Firm*—Morrison & Foerster LLP

(57) ABSTRACT

A waveform generator generates LED signal values that define an LED waveform and period. Each signal value is scaled by a particular scaling value to scale the amplitude of the LED waveform. The scaled LED waveform is then transmitted to an LED to cause the light emitted by the LED to pulse at a variable brightness.

19 Claims, 6 Drawing Sheets

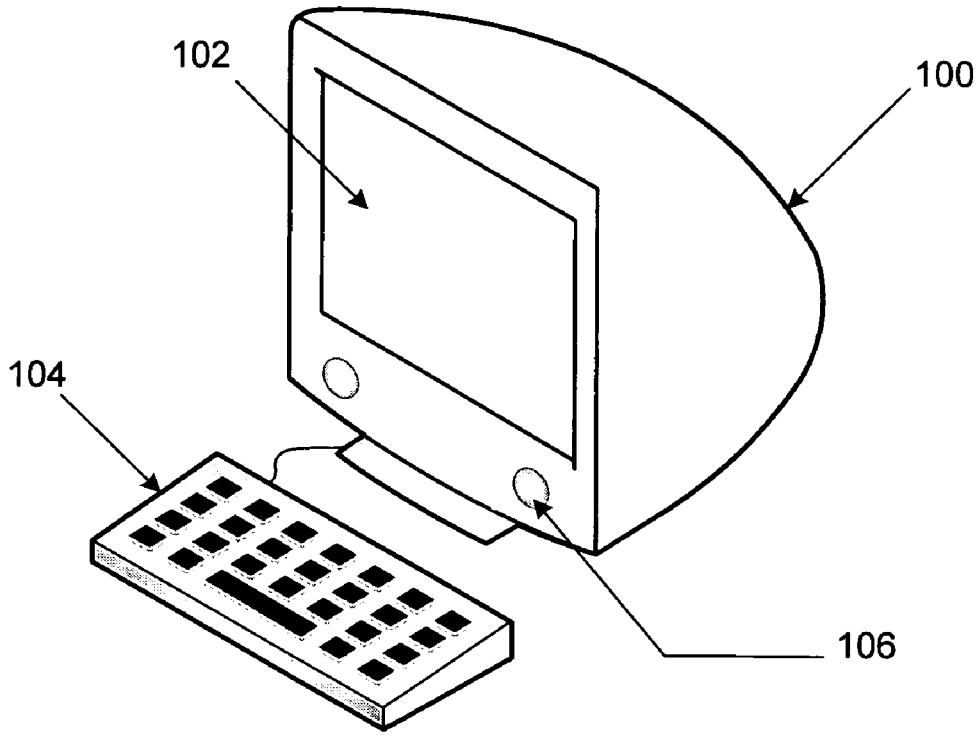
FIG. 1 – Prior Art
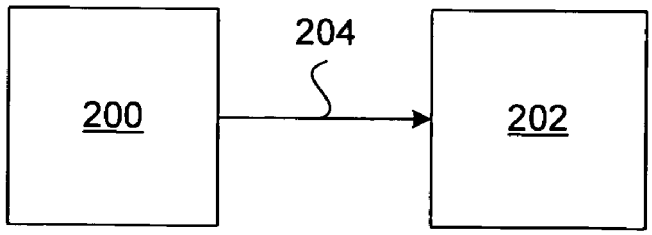
FIG. 2 – Prior Art

METHOD AND SYSTEM FOR VARIABLE LED OUTPUT IN AN ELECTRONIC DEVICE

BACKGROUND

Electronic devices such as computers, personal digital assistants, and monitors typically have multiple power states. Two power states are "on", when the device is operating at full power and "off", when the device is turned off and not using any power. Another power state is "sleep" or "hibernate", when the device is turned on but using less power than when in the "on" state. Sleep states are typically used to reduce energy consumption and to save battery life.

FIG. 1 is a right perspective view of a computer system according to the prior art. A user interacts with computer 100 and display 102 using keyboard 104. Button 106 may be used to turn on computer 100 or display 102, or it may be used to provide information to a user regarding a current power state of computer 100 or display 102. In the system shown in FIG. 1, button 106 is made of a transparent material that covers or overlays a light-emitting diode (LED). When computer 100 or display 102 is turned on, the LED emits light that transmits through button 106 and is seen by the user. When computer 102 enters the sleep state, the LED pulses to alert the user the computer is in the sleep state.

FIG. 2 is a data flow diagram for an LED signal in the computer system of FIG. 1. The data flow diagram includes waveform generator 200 and LED 202. Waveform generator 200 outputs a signal 204 that changes over time, which causes LED 202 to pulse. In some environments, such as dark rooms, the light emitted by LED 202 can be distracting or disruptive to the user.

SUMMARY

In accordance with the invention, methods and systems for variable LED output in an electronic device are provided. A waveform generator generates LED signal values that define an LED waveform and period. Each signal value is scaled by a particular scaling value to scale the amplitude of the LED waveform. The scaled LED waveform is then transmitted to an LED to cause the light emitted by the LED to pulse at a variable brightness.

BRIEF DESCRIPTION OF THE DRAWINGS

FIG. 1 is a right perspective view of a computer system according to the prior art;

FIG. 2 is a data flow diagram for an LED signal in the computer system of FIG. 1;

DETAILED DESCRIPTION

The following description is presented to enable one skilled in the art to make and use embodiments in accordance with the invention, and is provided in the context of a patent application and its requirements. Various modifications to the disclosed embodiments will be readily apparent to those skilled in the art, and the generic principles herein may be applied to other embodiments. Thus, the invention is not intended to be limited to the embodiments shown, but is to be accorded the widest scope consistent with the appended claims and with the principles and features described herein.

Figure 3:
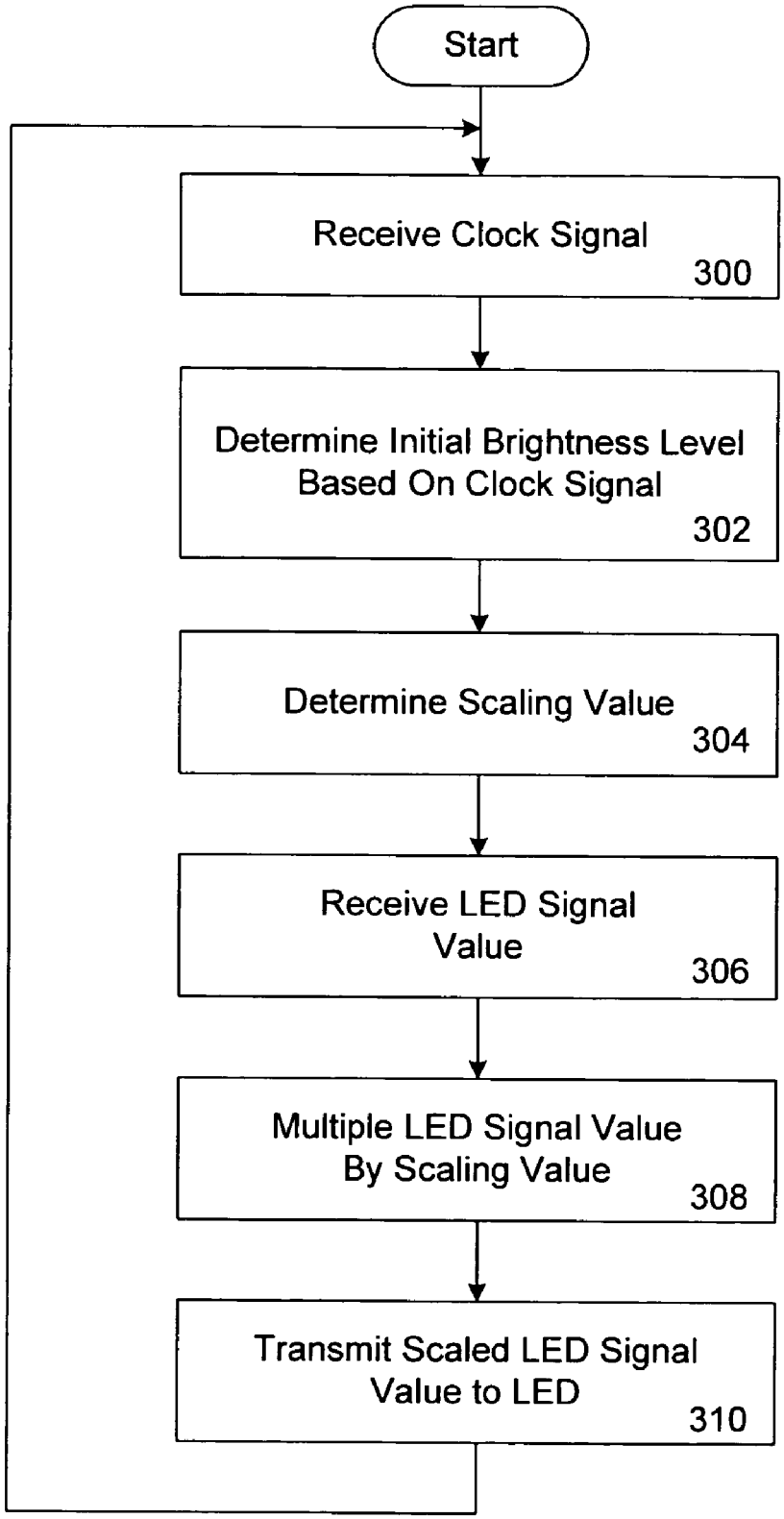
FIG. 3 is a flowchart of a method for pulsing light emitted from an LED in an embodiment in accordance with the invention.

With reference to the figures and in particular with reference to FIG. 3, there is shown a flowchart of a method for pulsing light emitted from an LED in an embodiment in accordance with the invention. Initially a clock signal is received, as shown in block 300. The clock signal includes a time of day from a real-time clock in an embodiment in accordance with the invention.

Based on the time of day, an initial brightness level is determined at block 302. The initial brightness level is defined as a percentage of maximum brightness of an LED. A scaling value is then determined using the percentage of maximum brightness (block 304). The scaling value ranges from 0.00 to 1.00 in an embodiment in accordance with the invention.

An LED signal value is received and the scaling value applied to the LED signal value (blocks 306, 308). A scaled LED signal value is then transmitted to an LED at block 310 to cause the LED to emit light at a given percentage of maximum brightness. The method returns to block 300 and repeats each second of the real-time clock in an embodiment in accordance with the invention.

Figure 4:
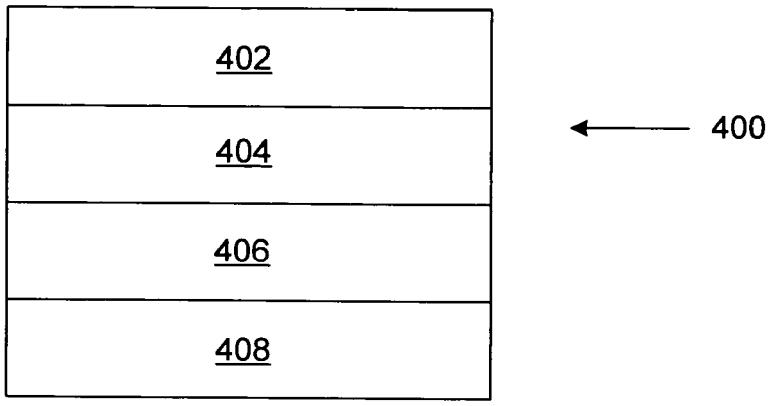
FIG. 4 is diagram of a data structure in an embodiment in accordance with the invention.

FIG. 4 is a diagram of a data structure in an embodiment in accordance with the invention. Data structure 400 is used in block 302 of FIG. 3. Data structure 400 includes four data values in an embodiment in accordance with the invention. In other embodiments in accordance with the invention, data structure 400 may include any number of data values.

Data values 402, 404, 406, 408 define values associated with a percentage of brightness and times of day that are pre-stored in data structure 400 in an embodiment in accordance with the invention. Data value 402 defines a sunrise time, data value 404 a sunset time, data value 406 a duration of time for twilight, and data value 408 a night light percentage. Sunrise time is set to a given time of morning, such as, for example, 8 am local time. Sunset time is set to a given time of evening, such as, for example, 8 pm local time. The duration of time for twilight is set to a particular length of time, such as, for example, 1 hour. And night light percentage is set to a given percentage of the maximum brightness, such as, for example, 24%. Data structure 400 is one of the inputs into a state machine function that determines the percentage of maximum brightness of an LED. The state machine function is described in conjunction with FIG. 5.

Figure 5:
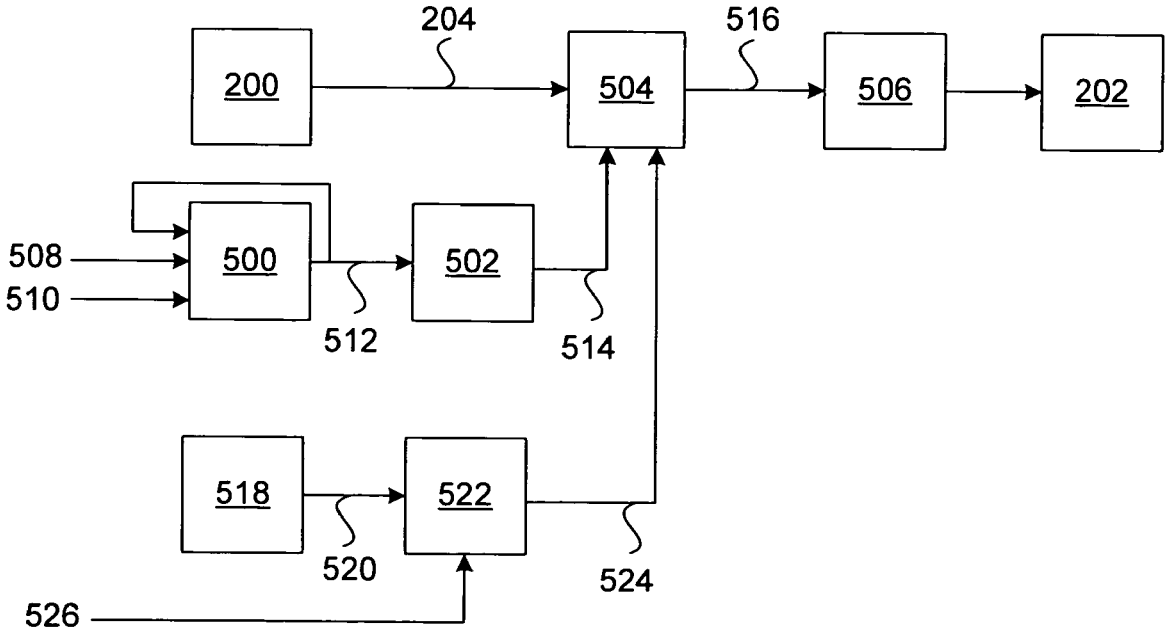
FIG. 5 is a data flow diagram for generating a scaled LED waveform in an embodiment in accordance with the invention.

FIG. 5 is a data flow diagram for generating a scaled LED waveform in an embodiment in accordance with the invention. The data flow diagram includes waveform generator 200 and LED 202 from FIG. 2. The data flow diagram also includes state machine function 500, scaling function 502, multiplier 504, and slew rate filter 506. State machine function 500 includes four states in an embodiment in accordance with the invention. The four states are day, night, dawn, and dusk. Day is defined as sunrise to sunset (see data values 402, 404 in FIG. 4). Dawn occurs just before sunrise and is defined as the amount of time given in twilight data value 406. For example, if twilight data value is defined as one hour, dawn is set to the hour just after sunrise, which in the earlier example is 7-8 am.

Dusk occurs just after sunset and is also governed by the twilight data value 406. For example, if twilight data value is provided as one hour, dusk is defined as the hour just after sunset, or as 6-7 pm. The remaining hours of the day not included in day, dawn, and dusk are night. In other embodiments in accordance with the invention, state machine unit 300 may include any number of states. For example, state machine unit 300 may include only the two states of day and night.

State machine function is implemented as a Mealy state machine in an embodiment in accordance with the invention. Inputs 508, 510 include the current time of day from a real-time clock (not shown), some or all of the data values 402, 404, 406, 408 from data structure 400 (FIG. 4), and the current state of state machine function 500. In other embodiments in accordance with the invention, the inputs into state machine 500 can differ from those shown in FIG. 5. For example, one input can include user options, which is discussed in more detail in conjunction with FIG. 9.

State machine function 500 generates output 512 each time a second passes on the real-time clock in an embodiment in accordance with the invention. Output 512 is an initial scaling value that represents a percentage of a particular LED brightness level. For example, output 512 from state machine function 500 is a percentage of maximum LED brightness in an embodiment in accordance with the invention.

Scaling function 502 receives output 512 from state machine function 500, and based on this information, calculates one or more final scaling values. Scaling function 502 generates each scaling value using the equation:

$$\text{Scaled LED signal value (510)}=[P/(1+k(1-P))]*\text{maximum brightness value of LED},$$

where P is the output of state machine function 500, k is an environment constant, and [P/(1+k(1−P))] defines a final scaling value. In one embodiment in accordance with the invention, k is a fixed value equal to 1.64925 and P is based on the state. For the state of day, for example, P is equal to 1.00 (or 100%) and for night, P is equal to 0.24 (24%). For the states of dusk and dawn, P is determined by the equation:

$$P=(\text{time[dusk or dawn]ends}-\text{current time of day})/\text{total amount of time for dusk or dawn}$$

Thus, the value of P for dusk and dawn is a changing value that decreases as the time from the real-time clock moves closer to the next state of night and day, respectively. For example, when dusk first begins, P is equal to 1.00. The value of P decreases as the time from the real-time clock moves closer to night.

Figure 6:
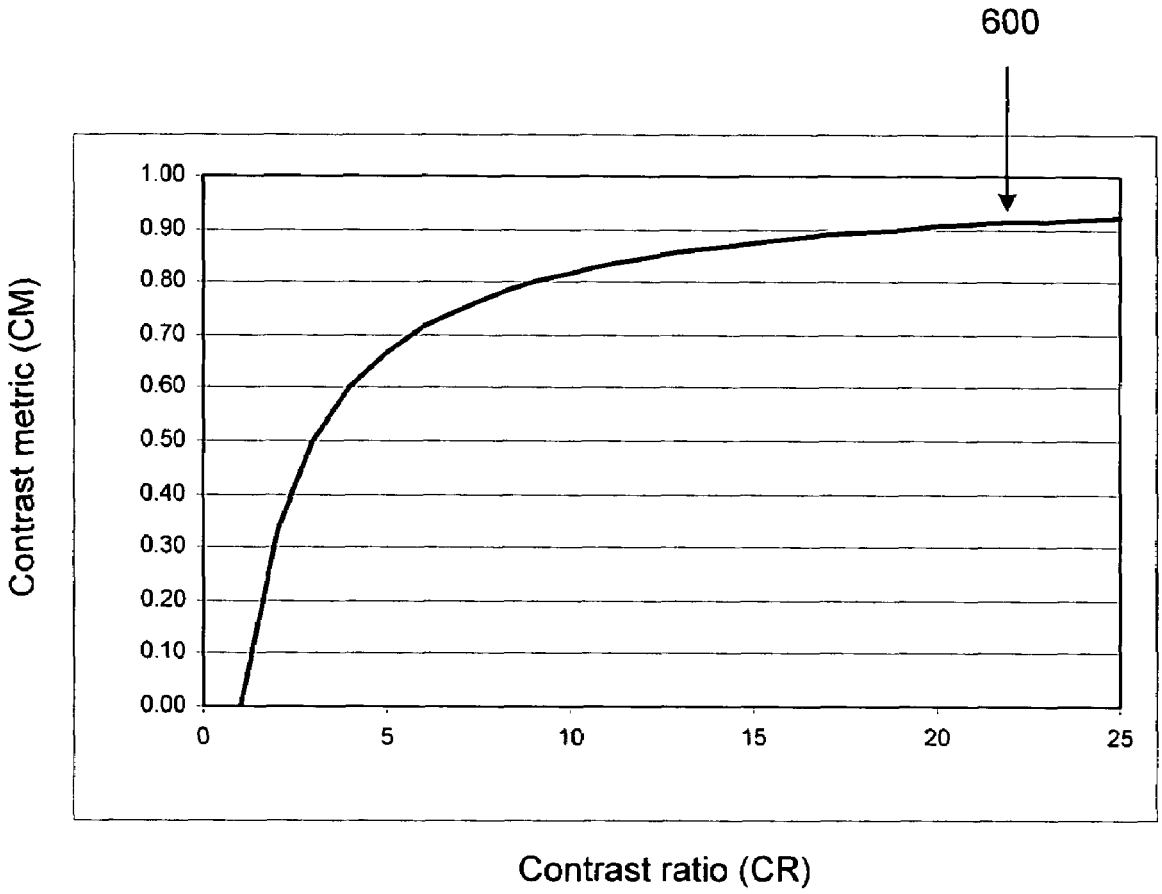
FIG. 6 is a plot of contrast metric values versus contrast ratio values in an embodiment in accordance with the invention.

In another embodiment in accordance with the invention, the final scaling values defined by [P/(1+k(1−P))] are based on the human perception of brightness. In perceiving "brightness," the human eye does not perceive the brightness (i.e., luminance) of the LED by itself, but rather the contrast between the luminance measured at the LED to the luminance measured at another point on the area surrounding the LED (that is not backlit by the LED). The area surrounding the LED is a bezel or housing enveloping a computer or computer display in an embodiment in accordance with the invention. A contrast ratio (CR) value is defined as:

$$CR=(L_B+L_{LED})/L_B,$$

where $L_B$ is the measured luminance of the bezel and $L_{LED}$ is the measured luminance of the LED. A linear scale of the human ability to differentiate contrast from a value of zero (where there is no difference in brightness between two sources) and a value of one (where a small additional variation in contrast can no longer be perceived) is then generated. FIG. 6 is a plot of contrast metric values versus contrast ratio values in an embodiment in accordance with the invention. The contrast metric (CM) values are represented on the y-axis and the CR values on the x-axis. The contrast metric assumes a person's ability to differentiate between subtle differences in contrast is quickly lost once an absolute amount of contrast exceeds a certain threshold. For example, as the CR value increases beyond 10.00 in FIG. 6 the CM value for curve 600 remains fairly constant.

The CM value relates to the CR value according to the equation:

$$CM=(CR-1)/(CR+1)=L_{LED}/(2*L_B+L_{LED}),$$

where $L_B$ is a function of the light in the room and the reflective properties of the bezel. Therefore, an alternative representation of the equation for CM is:

$$CM=L_{LED}/(2*r*E+L_{LED}),$$

where E is the measured brightness of the room and r is a proportionality constant that relates the reflective properties of the bezel. In one embodiment in accordance with the invention, r=0.223. In other embodiments in accordance with the invention r may equal different values.

To account for the nonlinearity of the human perception of contrast, and to produce scaling values that cause the brightness of the LED to vary in a fashion that is perceived to be linear, the contrast metric (CM) is controlled linearly in an embodiment in accordance with the invention. The luminance of the LED is therefore varied in a manner that allows the CM to be maintained as a linear function.

Figure 7:
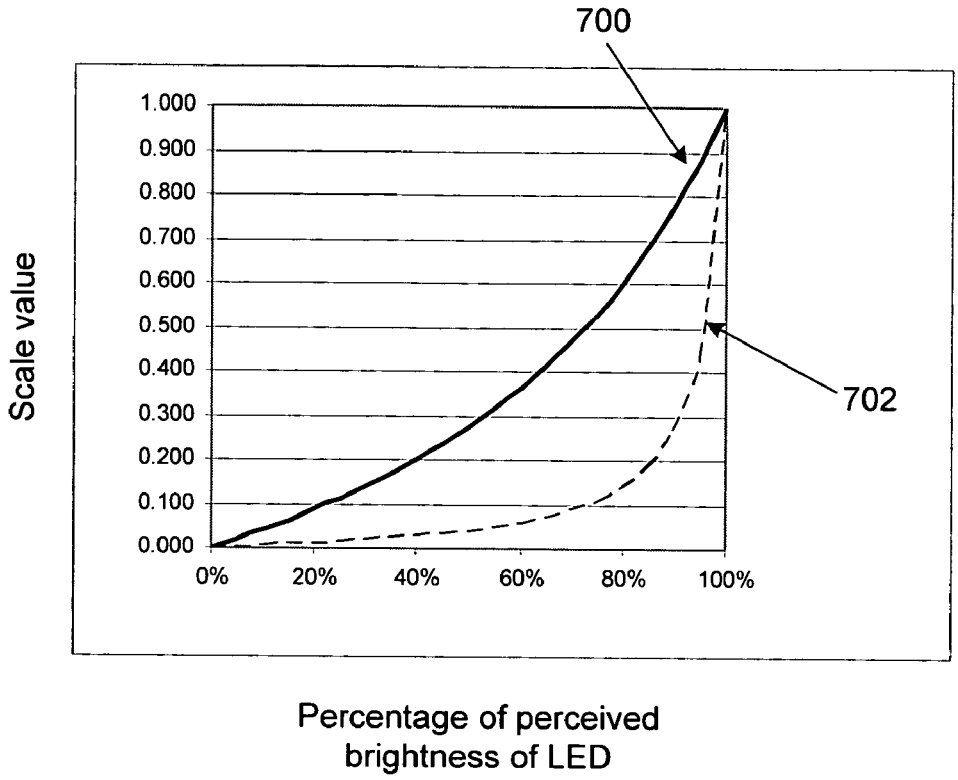
FIG. 7 is a plot illustrating the relationship between scaling values and percentages of perceived brightness that are based on the plot of FIG. 6.

FIG. 7 is a plot illustrating the relationship between scaling values and percentages of perceived brightness that are based on the plot of FIG. 6. The y-axis represents the scaling values while the x-axis represents the percentages (0-100%) of perceived brightness of the LED when driven to a maximum brightness. As discussed earlier, the scaling values cause the brightness of the LED to vary in a manner that is perceived to be linear.

Curve 700 illustrates the relationship of scaling values to percentages of perceived brightness in an embodiment in accordance with the invention. As the contrast metric value (see FIG. 6) decreases toward zero, the curve in curve 700 becomes more pronounced and moves toward the lower-right corner of the plot (see curve 702). Similarly, curve 700 becomes more linear as the contrast metric value increases toward one.

Returning again to FIG. 5, the final scaling values are output 514 from scaling function 502 and input into multiplier 504. Multiplier 504 then multiplies each LED signal value 204 generated by waveform generator 200 by a corresponding final scaling value to produce scaled LED signal values 516. Scaled LED signal values 516 are input into slew rate filter 506. Slew rate filter 506 analyzes the scaled LED signal values 516 by comparing a current scaled LED signal value against a preceding scaled LED signal value in an embodiment in accordance with the invention. Slew rate filter 506 calculates a difference value between the subsequent and prior scaled LED signal values and compares the difference value against a maximum difference value. When the calculated difference value exceeds the maximum difference value, slew rate filter 506 adds the maximum difference value to the prior scaled LED signal value and transmits the resulting scaled LED signal value to LED 202. When the calculated difference value is equal to or less than the maximum difference value, slew rate filter 506 transmits the subsequent scaled LED signal value to LED 202.

The brightness of the light emitted from LED 202 can also be varied based on the amount of light in the surrounding environment in an embodiment in accordance with the invention. Light sensor 518 measures the light in the surrounding environment, such as in a room, and generates signal 520 that represents the amount of measured light. Light sensor 518 includes a software-selectable integration time function in an embodiment in accordance with the invention. This function collects light over the duration of the integration time. The integration time function outputs a measurement value (i.e., signal 520) when the integration time expires. The integration time may be set to any given value, and is set to 402 milliseconds in an embodiment in accordance with the invention.

In other embodiments in accordance with the invention, light sensor 518 may output light measurement values using other techniques. By way of example only, light sensor 518 may output light measurement values based upon user actions, such as pressing a button or setting a sample interval in a control panel. Light sensor 518 alternatively may output a light measurement value when light or brightness changes in the surrounding environment exceed a predetermined threshold.

Signal 520 is input into scaling function 522. Scaling function 522 determines a target contrast metric (CM) as a linear function of E in an embodiment in accordance with the invention. The parameter E represents the value of signal 520 (i.e., the measurement value). CM is calculated using the equation:

$$CM(E)=(CM_{LO}(E_{HI}-E)+CM_{HI}(E-E_{LO}))/(E_{HI}-E_{LO}),$$

where $E_{HI}$ represents the maximum illumination threshold and $E_{LO}$ the minimum illumination threshold. The values $CM_{LO}$ and $CM_{HI}$ are calculated using the following equations:

$$CM_{LO}=L_{MIN}/(2*r*E_{LO}+L_{MIN})$$

$$CM_{HI}=L_{MAX}/(2*r*E_{HI}+L_{MAX}),$$

where $L_{MIN}$ represents the LED brightness when $E<E_{LO}$, $L_{MAX}$ the LED brightness when $E>E_{HI}$, and r is the proportionality constant that relates the reflective properties of the bezel in an embodiment in accordance with the invention. The values for $L_{MIN}$ and $L_{MAX}$ are represented in units of candela per square meter and E, $E_{LO}$, and $E_{HI}$ are represented in units of lux.

Once CM(E) is calculated, the amount of luminance the LED must produce to achieve the calculated CM(E) is determined using the equation:

$$L(CM(E))=2*r*E*CM(E)/(1-CM(E))$$

The scaling value is then expressed as $L/L_{MAX}$. The scaling value 524 is transmitted to multiplier 504, which multiplies one or more LED signal values by the scaling value 524. Scaling value 524 may be calculated differently in other embodiments in accordance with the invention. For example, a user or device manufacturer may set scaling value 524 to one or more particular levels using a control panel in an embodiment in accordance with the invention. The one or more particular levels are input into scaling function 522 via input 526.

In another embodiment in accordance with the invention, scaling value 524 may be calculated using different environmental parameters. For example, a user or device manufacturer may determine arbitrary ambient illumination thresholds or LED luminance levels using a control panel. The one or more particular levels are input into scaling function 522 via input 526.

Embodiments in accordance with the invention may use the state machine 500 data path, the light sensor 518 data path, or both the state machine 500 and light sensor 518 data paths to vary the brightness of the light emitted by LED 202. Selection of one or both paths may be performed by a user or by a manufacturer. Selection may be achieved, for example, through a control panel in an embodiment in accordance with the invention.

Figure 8:
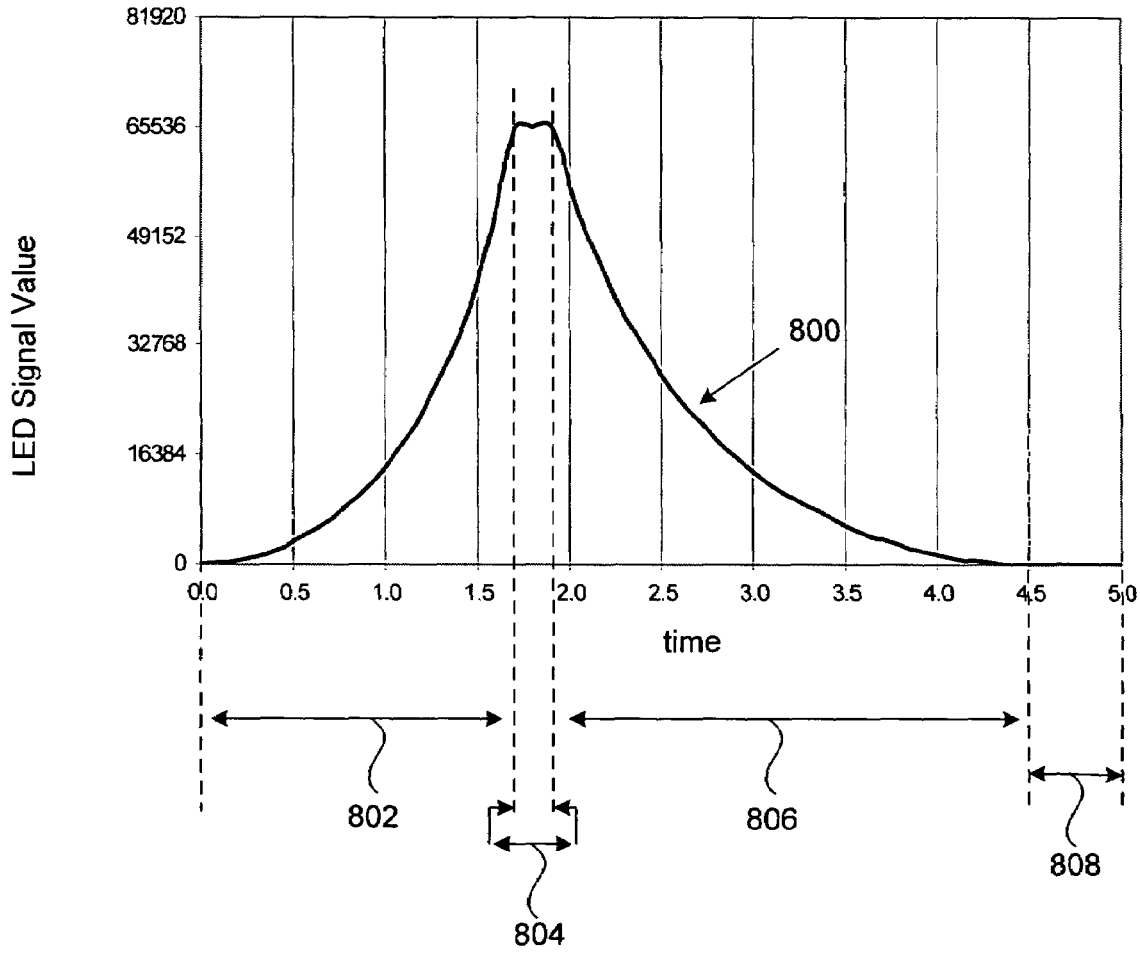
FIG. 8 is a waveform diagram of signal 204 in an embodiment in accordance with the invention.

Referring to FIG. 8, there is shown a waveform diagram of signal 204 in an embodiment in accordance with the invention. Waveform 800 includes four sections 802, 804, 806, 808. Section 802 has a duration of 1.7 seconds, section 804 a duration of 0.2 seconds, section 806 a duration of 2.6 seconds, and section 808 a duration of 0.5 seconds in an embodiment in accordance with the invention.

Waveform 800 is calculated using two equations in an embodiment in accordance with the invention. Quadratic equation Q(t)=k*t^2 and exponential equation X(t)=256*(exp(k*t)−1) are used to generate values for particular moments in time. The calculated values of Q(t) and X(t) are averaged (Q(t)+X(t))/2 for each given moment in time. The averaged values are then used to generate waveform 800 in an embodiment in accordance with the invention.

The constants k in Q(t) and X(t) are calculated to make waveform 800 rise and fall in the prescribed durations. For example, the constant k in Q(t) is defined by the equation k=C/T^2 and the constant k in X(t) is defined as k=ln(1+C/256)/T, where T is the time duration of waveform section 802 and 804 and C is a given LED signal value. For example, C equals 65534, or the peak value of waveform 800, in an embodiment in accordance with the invention. The time duration for section 802 is 1.7 seconds while the time duration for section 806 is 2.6 seconds in an embodiment in accordance with the invention.

The LED signal value section 808 is zero. The LED signal value in section 804 is the maximum LED signal value in an embodiment in accordance with the invention. The maximum LED signal value is 65534, but the LED signal value for section 804 can be fixed at any value.

Figure 9:
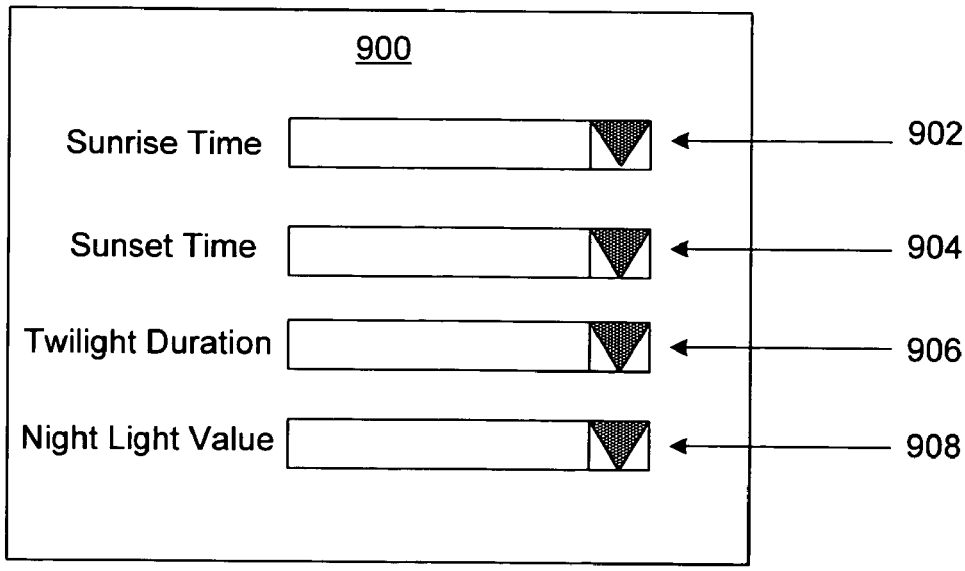
FIG. 9 is a diagrammatic illustration of a user preference window in an embodiment in accordance with the invention.

FIG. 9 is a diagrammatic illustration of a user preference window in an embodiment in accordance with the invention. The values stored in data structure 400 (FIG. 4) may be selected by a user in other embodiments in accordance with the invention. User preference window 900 includes selection boxes for sunrise 902, sunset 904, twilight duration 906, and night light 908. When a user "clicks" on the downward facing arrow to the right of the box, a drop down menu appears that includes a number of possible values for sunrise, sunset, twilight duration, and night light. In other embodiments in accordance with the invention, other types of user selection mechanisms may be used. For example, instead of drop down menus 902,904, 906 908, a user can select value for sunrise, sunset, twilight duration, and night light using sliders or dialog boxes.

Variable LED output may be implemented in any type of electronic device. Examples of such devices include, but are not limited to, computers, personal digital assistants (PDAs), portable playback devices for music or video, and display devices. Moreover, varying the brightness of an LED is not limited to the function of informing a user of one or more different power states. The brightness of an LED may vary for any particular purpose.

The invention claimed is:

1. A system in an electronic device for emitting light from a light-emitting diode (LED) at a variable brightness, comprising:

a waveform generator for generating an LED signal waveform comprised of a plurality of LED signal values; and a processing unit for determining a scaling value for one or more LED signal values in the plurality of LED signal values, wherein the scaling value scales the one or more LED signal values based upon a percentage of a particular LED brightness.

2. The system of claim 1, wherein the processing unit comprises a state machine unit operable to receive a time of day and determine a percentage of a particular LED brightness based on the time of day.

3. The system of claim 2, wherein the processing unit further comprises a scaling unit operable to receive the percentage of a particular LED brightness based on the time of day and determine a scaling value for each of the plurality of LED signal values using the percentage of a particular LED brightness.

4. The system of claim 3, wherein the processing unit further comprises a multiplier operable to multiply the plurality of LED signal values by respective scaling values.

5. The system of claim 1, wherein the processing unit comprising an ambient light sensor operable to sense an amount of light and generate a signal representing the amount of light.

6. The system of claim 5, wherein the processing unit further comprises a scaling unit operable to receive the signal representing the amount of light and operable to determine a scaling value for one or more LED signal values in the plurality of LED signal values.

7. The system of claim 6, wherein the processing unit further comprises a multiplier operable to multiply one or more LED signal values in the plurality of LED signal values by respective scaling values.

8. The system of claim 1, further comprising a slew rate filter operable to receive the scaled LED signal values and operable to analyze each scaled LED signal value with a previous scaled LED signal value.

9. A method for varying a brightness of light emitted from a light-emitting diode (LED) in an electronic device, comprising:

a) generating an LED signal waveform comprised of a plurality of LED signal values;

b) determining a scaling value for one or more LED signal values in the plurality of LED signal values, wherein the scaling value is based upon a percentage of a particular LED brightness; and c) generating one or more scaled LED signal values by scaling the one or more LED signal values with the scaling value.

10. The method of claim 9, further comprising:

d) transmitting the one or more scaled LED signal values to a light emitting diode.

11. The method of claim 9, further comprising repeating a) through d) for all of the LED signal values in the plurality of LED signal values.

12. The method of claim 9, wherein determining a scaling value for one or more LED signal values in the plurality of LED signal values comprises:

receiving a clock signal representing a time of day; and determining the percentage of a particular LED brightness, wherein the percentage comprises one or more initial brightness percentages based on the clock signal.

13. The method of claim 12, wherein determining a scaling value for one or more LED signal values in the plurality of LED signal values comprises calculating a scaling value for one or more LED signal values in the plurality of LED signal values using the one or more initial brightness percentages.

14. The method of claim 13, wherein calculating a scaling value for one or more LED signal values in the plurality of LED signal values using the one or more initial brightness percentages comprises calculating each scaling value using the equation $[P/(1+k(1-P))]$, where P is the initial brightness percentage and k an environmental constant.

15. The method of claim 12, wherein calculating a scaling value for one or more LED signal values in the plurality of LED signal values using the one or more initial brightness percentages comprises calculating a scaling value for one or more LED signal values based on a human perception of brightness and using the one or more initial brightness percentages.

16. The method of claim 9, wherein generating one or more scaled LED signal values by scaling the one or more LED signal values with the scaling value comprises multiplying the one or more scaling values with one or more respective LED signal values for the light-emitting diode.

17. The method of claim 9, wherein determining a scaling value for one or more LED signal values in the plurality of LED signal values comprises:

measuring an amount of light in an area;

generating a signal representative of the amount of measured light; and determining the particular LED brightness.

18. The method of claim 17, wherein determining a scaling value for one or more LED signal values in the plurality of LED signal values comprises calculating a scaling value for one or more LED signal values in the plurality of LED signal values using the signal representative of the amount of measured light.

19. The method of claim 9, further comprising:

calculating a difference between each scaled LED signal value and a previous scaled LED signal value; and determining whether each difference exceeds a threshold value.

* * * * *